US006338900B1

(12) United States Patent
Tada et al.

(10) Patent No.: US 6,338,900 B1
(45) Date of Patent: Jan. 15, 2002

(54) SOFT MAGNETIC COMPOSITE MATERIAL

(75) Inventors: Masahito Tada; Keiichiro Suzuki, both of Fukushima (JP)

(73) Assignee: Kureha Kagaku Kogyo K.K., Tokyo (JP)

( * ) Notice: Subject to any disclaimer, the term of this patent is extended or adjusted under 35 U.S.C. 154(b) by 0 days.

(21) Appl. No.: 09/367,947

(22) PCT Filed: Feb. 13, 1998

(86) PCT No.: PCT/JP98/00596

§ 371 Date: Aug. 24, 1999

§ 102(e) Date: Aug. 24, 1999

(87) PCT Pub. No.: WO98/36430

PCT Pub. Date: Aug. 20, 1998

(30) Foreign Application Priority Data

Feb. 13, 1997 (JP) ..... 9-047363

(51) Int. Cl.[7] ..... H01F 7/02

(52) U.S. Cl. ..... 428/402; 335/296; 335/297; 336/233; 75/348; 148/306; 252/62.53

(58) Field of Search ..... 428/329, 332, 428/694 BS, 402, 688; 335/281, 296, 297; 336/233; 75/245, 348; 148/306; 252/62.51–62.56

(56) References Cited

U.S. PATENT DOCUMENTS 5,198,138 A 3/1993 Yamamoto et al.
5,725,686 A * 3/1998 Yoshizawa et al. ..... 148/307
5,755,986 A * 5/1998 Yamamoto et al. ..... 252/62.54

FOREIGN PATENT DOCUMENTS

| | | |
|---|---|---|
| EP | 0220321 | 5/1987 |
| EP | 0394020 | 10/1990 |
| JP | 62-234304 | 10/1987 |
| JP | 2-278702 | 11/1990 |
| JP | 4-154625 | 5/1992 |
| JP | 5-090052 | 4/1993 |

OTHER PUBLICATIONS

Nomura, T. and Ochiai, T., "Current Topics in the Field of Materials Technology of Soft Ferrites", Ceram. Trans., vol. 47, p. 211–226 (1995).*

* cited by examiner

*Primary Examiner*—Stevan A. Resan
*Assistant Examiner*—Kevin M. Bernatz
(74) *Attorney, Agent, or Firm*—Dinsmore & Shohl LLP

(57) ABSTRACT

A soft magnetic composite material obtained by dispersing a powdered magnetic material (A) composed of soft ferrite in a polymer (B), wherein the powdered magnetic material (A) is a powdered magnetic material of a random form obtained by grinding a sintered magnetic material, and the average particle size ($d_2$) of the powdered magnetic material (A) is greater than the average crystal grain size ($d_1$) of the sintered magnetic material by at least twice.

21 Claims, No Drawings

SOFT MAGNETIC COMPOSITE MATERIAL

TECHNICAL FIELD

The present invention relates to a soft magnetic composite material obtained by dispersing a powdered magnetic material composed of soft ferrite in a polymer, and more particularly to a soft magnetic composite material which has moderate permeability and moreover exhibits high electrical insulating property and has excellent dielectric strength.

BACKGROUND ART

Compounds ($MO \cdot Fe_2O_3$) composed of ferric oxide and an oxide of a divalent metal are generally soft magnetic materials having high permeability $\mu$ and are called soft ferrite. The soft ferrite is produced by a method of powder metallurgy and is hard and lightweight. Among various kinds of soft ferrite, Ni—Zn ferrite, Mg—Zn ferrite and Cu ferrite have feature that the resistivity is high, and the permeability is high in a high-frequency band. The soft ferrite is a ferrimagnetic oxide and mainly has a spinel type crystal structure. However, those having a ferroxplana type or garnet type crystal structure are also included. The soft ferrite has heretofore been used as a deflecting yoke material, high-frequency transformer, magnetic head material, etc.

The soft ferrite has a defect that it is fragile. However, it has been attempted to develop soft magnetic composite materials obtained by dispersing its powder in a polymer into new use applications as choke coils, rotary transformers, line filters, electromagnetic interference shielding materials (EMI shielding materials), etc., making the best use of its feature that the electric resistance is high. Since the soft magnetic composite materials use a polymer as a binder, they can be formed into molded or formed products of desired shapes by various kinds of molding or forming methods such as injection molding, extrusion and compression molding. However, a soft magnetic composite material obtained by dispersing soft ferrite powder having a high electric resistance in a polymer having high electrical insulating property has involved problems that it does not exhibit such a high electric resistance as expected from the electrical properties of both components, and is poor in dielectric strength.

The soft ferrite is generally produced as a sintered magnetic material through the steps of (i) mixing, (ii) calcination, (iii) grinding, (iv) granulation, (v) molding and (vi) sintering of raw materials such as $Fe_2O_3$, CuO, NiO, MgO and ZnO (dry process). A method in which finely particulate oxide powder is prepared by a co-precipitation process or atomization and thermal decomposition process also exists. In any method, oxide powder is formed into a sintered magnetic material through the steps of granulation, molding and sintering. The soft ferrite exhibits a high electric resistance (electrical insulating property) in the state of sintered magnetic material. However, it shows a tendency to markedly lower its electrical insulating property when the sintered magnetic material is ground and the resultant powdered magnetic material is blended with a polymer to prepare a composite material (resin composition).

Therefore, a molded or formed product obtained by molding or forming the composite material with the powdered magnetic material composed of the soft ferrite dispersed in the polymer cannot be used in an application field of which high electrical insulating property is required. In particular, such a molded or formed product has involved a problem that when it is used as a part of a power supply apparatus, such as a line filter of which dielectric strength of 1,500 V or higher is required, it generates heat during use or test to become unusable. Among various kinds of soft ferrite, Mg—Zn ferrite, Ni—Zn ferrite and Cu ferrite exhibit a high electric resistance in the state of sintered magnetic material. However, each of them shows a tendency to markedly lower the electric resistance when the sintered magnetic material is ground and the resultant powdered magnetic material is dispersed in a polymer.

DISCLOSURE OF THE INVENTION

It is an object of the present invention to provide a soft magnetic composite material which has moderate permeability and moreover exhibits high electrical insulating property and has excellent dielectric strength.

The present inventors have carried out an extensive investigation with a view toward overcoming the above-described problems involved in the prior art. As a result, it has been found that when soft ferrite in a sintered state is ground into a powdered magnetic material in such a manner that the average particle size of the powdered magnetic material amounts to at least twice the average crystal grain size of the sintered magnetic material, a soft magnetic composite material exhibiting a high electric resistance and having far excellent dielectric strength can be obtained by dispersing such a powdered magnetic material in a polymer to prepare the composite material.

Even when the average particle size of the powdered magnetic material is made comparatively small, high dielectric strength can be achieved so far as conditions of granulation, sintering, etc. are controlled in such a manner that the average crystal grain size of the resulting sintered magnetic material becomes small. Accordingly, the powdered magnetic material even in particle size distribution and comparatively small in particle size can be uniformly dispersed in the polymer, thereby providing a high-quality soft magnetic composite material. In the present invention, a soft magnetic composite material having particularly excellent dielectric strength and moderate permeability can be provided when Mg—Zn ferrite is used as the soft ferrite.

The present invention has been led to completion on the basis of these findings.

According to the present invention, there is thus provided a soft magnetic composite material obtained by dispersing a powdered magnetic material (A) composed of soft ferrite in a polymer (B), wherein the powdered magnetic material (A) is a powdered magnetic material of a random form obtained by grinding a sintered magnetic material, and the average particle size ($d_2$) of the powdered magnetic material (A) is greater than the average crystal grain size ($d_1$) of the sintered magnetic material by at least twice.

The powdered magnetic material (A) composed of soft ferrite may be preferably a powdered magnetic material composed of Mg—Zn ferrite.

BEST MODE FOR CARRYING OUT THE INVENTION

The soft ferrite useful in the practice of the present invention is a compound ($MO \cdot Fe_2O_3$) composed of ferric oxide ($Fe_2O_3$) and an oxide (MO) of a divalent metal and is generally produced as a sintered material through the steps of mixing, calcination, grinding, granulation, molding and sintering of the raw materials by a dry process. When high-quality ferrite is produced, a co-precipitation process and an atomization and thermal decomposition process are used. Typical raw materials include $Fe_2O_3$, $MnO_2$, $MnCO_3$, CuO, NiO, MgO, ZnO, etc.

In the dry process, the respective raw materials are mixed on the basis of calculation so as to give the prescribed blending ratio. In the calcination step, the mixture is generally heated to a temperature of 850 to 1,100° C. in a furnace. The calcined ferrite is ground into powder having a particle size of about 1 to 1.5 $\mu$m. Before molding the ferrite powder in a mold, it is granulated into granules to attain a high bulk density and good flowability. The granulated ferrite powder is filled into the mold and compression-molded into the prescribed form by a molding machine. The molded ferrite is sintered in a large-sized tunnel type electric furnace or the like.

In the co-precipitation process, a strong alkali is added to an aqueous solution of metal salts to precipitate hydroxides. The hydroxides are oxidized to obtain finely particulate ferrite powder. The ferrite powder is formed into a sintered magnetic material through the steps of granulation, molding and sintering. In the atomization and thermal decomposition process, an aqueous solution of metal salts is subjected to thermal decomposition to obtain finely particulate oxides. The powdered oxides are formed into a sintered magnetic material through the steps of grinding, granulation, molding and sintering.

In the present invention, the ferrite powder is preferably granulated by a spray drying method in the granulation step in order to attain high dielectric strength. In the dry process, for example, a binder and a lubricant are added to a ferrite slurry subjected to wet grinding after the calcination step, and the resultant mixture is spray dried by means of a spray drier to obtain granules of about 100 to 150 $\mu$m. The ferrite powder obtained by the co-precipitation process or atomization and thermal decomposition process may be granulated by the spray drying method. The crystal grains of the soft ferrite mainly have a spinel type crystal structure.

The soft ferrite is classified into various kinds of ferrite, for example; Mn—Zn, Mg—Zn, Ni—Zn, Cu, Cu—Zn, Cu—Zn—Mg and Cu—Ni—Zn types, according to the kinds of oxides (MO) of divalent metals. The present invention can bring about excellent effects when the invention is applied to the Ni—Zn ferrite, Mg—Zn ferrite and Cu ferrite among these, the electric resistances of which are each lowered to a great extent when its sintered magnetic material is ground and dispersed as a powdered magnetic material in a polymer. Far excellent effects can be brought about when applied to the Mg—Zn ferrite in particular.

The Mg—Zn ferrite generally means that having a composition represented by the general formula, $(MgO)_x(ZnO)_y \cdot Fe_2O_3$, wherein x and y individually represent a compositional proportion. The Mg—Zn ferrite may also be that obtained by substituting a part of Mg by another divalent metal such as Ni, Cu, Co or Mn. Any other additive may be added thereto so far as no detrimental influence is thereby imposed on the properties inherent in the ferrite. In order to suppress the deposition of hematite, it is particularly preferred to control the content of the iron oxide. In the present invention, it is particularly preferred that the powdered magnetic material (A) be composed of the Mg—Zn ferrite in that a soft magnetic composite material having particularly high dielectric strength and moderately high permeability can be provided.

The Ni—Zn ferrite generally means that having a composition represented by the general formula, $(NiO)_x(ZnO)_y \cdot Fe_2O_3$. The Ni—Zn ferrite may also be that obtained by substituting a part of Ni by another divalent metal such as Cu, Mg, Co or Mn. Any other additive may be added thereto so far as no detrimental influence is thereby imposed on the properties inherent in the ferrite. In order to suppress the deposition of hematite, it is particularly preferred to control the content of the iron oxide.

The Cu ferrite generally means that having a composition represented by the general formula, $(CuO) \cdot Fe_2O_3$. The Cu ferrite may also be that obtained by substituting a part of Cu by another divalent metal such as Ni, Zn, Mg, Co or Mn. Any other additive may be added thereto so far as no detrimental influence is thereby imposed on the properties inherent in the ferrite. In order to suppress the deposition of hematite, it is particularly preferred to control the content of the iron oxide.

In the present Invention, a powdered magnetic material obtained by grinding a sintered magnetic material is used. According to this grinding method, a powdered magnetic material (A) having a desired average particle size can be prepared with ease by the ordinary production process of soft ferrite powder. According to the grinding method, the average particle size ($d_2$) of the powdered magnetic material (A) can also be controlled so as to give a moderate size according to the average crystal grain size ($d_1$) of the sintered magnetic material. The form of the powdered magnetic material (A) obtained by the grinding method becomes a nonspherical random form.

The sintered magnetic material is ground by using a grinding means such as a hammer mill, rod mill or ball mill. In the grinding, the sintered magnetic material is ground in such a manner that the average particle size ($d_2$) of the resulting powdered magnetic material (A) is greater than the average crystal grain size ($d_1$) of the sintered magnetic material by at least twice. Namely, in the grinding step, the average particle size ($d_2$) of the powdered magnetic material is controlled in such a manner that the relationship between the average particle size ($d_2$) of the powdered magnetic material and the average crystal grain size ($d_1$) of the sintered magnetic material satisfies the following expression (1):

$$2d_1 \leqq d_2 \quad (1)$$

According to the results of an investigation by the present inventors, it has been clarified that the electric resistance of a composite material containing a powdered magnetic material obtained by grinding a sintered magnetic material having an average crystal grain size ($d_1$) and a polymer lowers as the average particle size ($d_2$) of the powdered magnetic material thus obtained becomes smaller. The mechanism thereof is not known at this point of time. It is however considered that a layer of high electric resistance is lost by the breakdown of crystal grains, or that the sections of crystals newly formed by the grinding have a possibility of developing some defects. However, the present invention is not limited by any participating mechanism.

The relationship between the average particle size ($d_2$) of the powdered magnetic material and the average crystal grain size ($d_1$) of the sintered magnetic material preferably satisfies the following expression (2):

$$3d_1 \leqq d_2 \quad (2)$$

The upper limit of the multiplying factor of the average particle size ($d_2$) of the powdered magnetic material to the average crystal grain size ($d_1$) of the sintered magnetic material is preferably 10 times, more preferably 7 times. Accordingly, the relationship between the average particle size ($d_2$) of the powdered magnetic material (A) and the average crystal grain size ($d_1$) of the sintered magnetic material more preferably satisfies the following expression (3), particularly preferably the following expression (4):

$$2d_1 \leqq d_2 \leqq 10d_1 \quad (3)$$

$$3d_1 \leqq d_2 \leqq 7d_1 \quad (4)$$

The average particle size ($d_2$) of the powdered magnetic material (A) is preferably controlled by the grinding within a range of 10 μm to 1 mm, more preferably 20 to 500 μm, particularly preferably 20 to 50 μm. If the average particle size ($d_2$) of the powdered magnetic material (A) is smaller than 10 μm, it is difficult to raise the permeability of the resulting composite material. If the average particle size exceeds 1 mm on the other hand, the flowability of the resulting composite material in a mold is deteriorated when it is molded by injection molding or the like. It is hence not preferred to use a powdered magnetic material having an average particle size outside the above range.

The average crystal grain size ($d_1$) of the sintered magnetic material is preferably within a range of 2 to 50 μm, more preferably 3 to 15 μm. If the average crystal grain size ($d_1$) is too small, the permeability of the resulting composite material becomes insufficient. If the average crystal grain size ($d_1$) is too great on the other hand, the resulting composite material shows a tendency to lower its electric resistance. Accordingly, in the present invention, it is preferred to use a powdered magnetic material wherein the average crystal grain size ($d_1$) of the sintered magnetic material is within a range of 2 to 50 μm, and the average particle size of the powdered magnetic material (A) is within a range of 20 to 500 μm, with the proviso that the average particle size ($d_2$) of the powdered magnetic material (A) is greater than the average crystal grain size ($d_1$) of the sintered magnetic material by at least twice, preferably 2 to 10 times.

In the present invention, it is particularly preferred to use a powdered magnetic material wherein the average crystal grain size ($d_1$) of the sintered magnetic material is within a range of 3 to 15 μm, and the average particle size ($d_2$) of the powdered magnetic material (A) is within a range of 20 to 50 μm, from the viewpoints of the molding and processing ability, dielectric strength and permeability of the resulting composite material and the physical properties of products molded therefrom. In this case, the average particle size ($d_2$) of the powdered magnetic material (A) is greater than the average crystal grain size ($d_1$) of the sintered magnetic material by at least twice, preferably 2 to 10 times, more preferably 3 to 7 times.

The soft magnetic composite materials according to the present invention are preferably resin compositions comprising 50 to 95 vol. % of the powdered magnetic material (A) and 5 to 50 vol. % of a polymer (B). If the amount of the powdered magnetic material (A) is less than 50 vol. %, it is difficult to attain sufficient permeability in the resulting resin composition. If the amount exceeds 95 vol. % on the other hand, the flowability of the resulting resin composition in injection molding is extremely deteriorated. From the viewpoints of dielectric strength, permeability and moldability, more preferable blending proportions of the powdered magnetic material (A) and the polymer (B) are 55 to 75 vol. % and 25 to 45 vol. %, respectively.

Examples of the polymer (B) useful in the practice of the present invention include polyolefins such as polyethylene, polypropylene, ethylene-vinyl acetate copolymers and ionomers; polyamides such as nylon 6, nylon 66 and nylon 6/66; poly(arylene sulfides) such as poly(phenylene sulfide) and poly(phenylene sulfide ketone); polyesters such as polyethylene terephthalate, polybutylene terephthalate and aromatic polyesters; polyimide resins such as polyimide, polyether imide and polyamide-imide; styrene resins such as polystyrene and acrylonitrile-styrene copolymers; chlorine-containing vinyl resins such as polyvinyl chloride, polyvinylidene chloride, vinyl chloride-vinylidene chloride copolymers and chlorinated polyethylene; poly(meth) acrylates such as polymethyl acrylate and polymethyl methacrylate; acrylonitrile resins such as polyacrylonitrile and polymethacrylonitrile; thermoplastic fluorocarbon resins such as tetrafluoroethylene/perfluoroalkyl vinyl ether copolymers, tetrafluoroethylene/hexafluoropropylene copolymers and polyvinylidene fluoride; silicone resins such as dimethyl polysiloxane; various kinds of engineering plastics such as polyphenylene oxide, poly(ether ether ketone), poly(ether ketone), polyallylate, polysulfone and poly(ether sulfone); various kinds of thermoplastic resins such as polyacetal, polycarbonate, polyvinyl acetate, polyvinyl formal, polyvinyl butyral, polybutylene, polyisobutylene, polymethylpentene, butadiene resins, polyethylene oxide, oxybenzoyl polyester and poly-p-xylene; thermosetting resins such as epoxy resins, phenol resins and unsaturated polyester resins; elastomers such as ethylene-propylene rubber, polybutadiene rubber, styrene-butadiene rubber and chloroprene rubber; thermoplastic elastomers such as styrene-butadiene-styrene block copolymers; and mixtures of two or more of these polymers.

Of these polymers, polyolefins such as polyethylene and polypropylene, polyamides, and poly(arylene sulfides) such as poly(phenylene sulfide) are particularly preferred from the viewpoint of moldability. From the viewpoints of heat resistance, chemical resistance, flame retardant, weather resistance, electrical properties, moldability, dimensional stability and dielectric strength, poly(arylene sulfides) are more preferred, with poly(phenylene sulfide) being particularly preferred.

Various kinds of fillers such as fibrous fillers, plate-like fillers and spherical fillers may be incorporated into the soft magnetic composite materials according to the present invention with a view toward improving their mechanical properties, heat resistance and the like. Various kinds of additives such as flame retardants, antioxidants and colorants may also be incorporated into the soft magnetic composite materials according to the present invention as needed.

The soft magnetic composite materials according to the present invention can be produced by uniformly mixing the respective components. For example, the prescribed amounts of the powdered magnetic material and polymer are mixed by a mixer such as a Henschel mixer, and the mixture is melted and kneaded, whereby a soft magnetic composite material can be produced. The soft magnetic composite materials can be formed into molded or formed products of desired shapes by various kinds of molding or forming methods such as injection molding, extrusion and compression molding. The molded or formed products thus obtained have excellent dielectric strength and moderate permeability.

The dielectric strength of the soft magnetic composite materials according to the present invention is generally at least 1,500 V, preferably within a range of 1,500 to 8,000 V, more preferably within a range of 3,500 to 6,000 V. The relative permeability of the soft magnetic composite materials according to the present invention is generally at least 10, preferably within a range of 10 to 20. The soft magnetic composite materials according to the present invention can be provided as soft magnetic composite materials having dielectric strength of 3,500 to 6,000 V and relative permeability of generally 10 to 20, preferably 15 to 20 when Mg—Zn ferrite powder is particularly used as the powdered magnetic material (A).

The soft magnetic composite materials according to the present invention can be applied to a wide variety of uses such as coils, transformers, line filters and electromagnetic wave shielding materials.

EXAMPLES

The present invention will hereinafter be described more specifically by the following Examples and Comparative Examples. Physical properties in the examples were measured in accordance with the following respective methods:

(1) Average crystal grain size of sintered magnetic material:

A section of each sintered magnetic material sample was observed through a scanning electron microscope to measure crystal grain sizes, thereby calculating an average value (n=100 grains).

(2) Average particle size of powdered magnetic material:

Each powdered magnetic material sample was taken out twice by a microspatula and placed in a beaker. After 1 or 2 drops of an anionic surfactant (SN Dispersat 5468) were added thereto, the sample was kneaded by a rod having a round tip so as not to crush the powdered sample. The thus-prepared sample was used to determine an average particle diameter by means of a Microtrack FRA particle size analyzer 9220 manufactured by Nikkiso Co., Ltd.

(3) Dielectric strength:

Disk electrodes were brought into contact with both sides of each plate-like molded product sample having a thickness of 0.5 mm to find maximum alternating voltage, which may be applied to the sample for 60 seconds at a measuring temperature of 23° C. and a cut off current of 1 mA, by means of a dielectric strength tester TOS5050 manufactured by Kikusui Densi Kogyo K.K. Unit: V.

(4) Relative permeability:

Relative permeability of each sample was measured at 1 V and 100 kHz in accordance with JIS C 2561.

Example 1

After $Fe_2O_3$ (69.8 wt. %), ZnO (15.1 wt. %), MgO (10.5 wt. %), MnO (3.1 wt. %), CuO (1.1 wt. %), CaO (0.2 wt. %) and $BiO_3$ (0.2 wt. %) were mixed with one another and dried, the mixture was calcined at 1,000° C. Ferrite powder obtained by the calcination was granulated by a spray drying method, and the resultant granules were then sintered at a temperature up to 1,300° C. in an electric furnace to obtain a sintered material of Mg—Zn ferrite (A.C. initial permeability $\mu_{iac}$ at a measuring frequency of 100 kHz : 400). The section of the sintered magnetic material thus obtained was observed through a scanning electron microscope. As a result, it was found that the average crystal grain size of the crystal grains was 12 $\mu$m (n=100 grains). This sintered magnetic material was ground by a hammer mill to obtain a powdered magnetic material having an average particle size of 44 $\mu$m. The specific gravity of the powdered magnetic material thus obtained was 4.6.

In a 20-liter Henschel mixer, were mixed 17 kg of the resultant powdered magnetic material and 3 kg of poly (phenylene sulfide) (product of Kureha Kagaku Kogyo K.K.; melt viscosity at 310° C. and a shear rate of 1,000/sec:about 20 Pa·s). The resultant mixture was fed to a twin-screw extruder preset at 280 to 330° C. and melted and kneaded, thereby forming pellets. The pellets were fed to an injection molding machine (JW-75E manufactured by The Japan Steel Works, Ltd.) and injection-molded at a cylinder temperature of 280 to 310° C., an injection pressure of about 1,000 kgf/cm$^2$ and a mold temperature of about 160° C., thereby obtaining a plate-like molded product hanging a size of 10 mm×130 mm×0.8 mm. The dielectric strength of the resultant molded product was measured and found to be 5,000 V.

The above pellets were fed to an injection molding machine (PS-10E manufactured by Nissei Plastic Industrial Co., Ltd.) and injection-molded at a cylinder temperature of 280 to 310° C., an injection pressure of about 1,000 kgf/cm$^2$ and a mold temperature of about 160° C., thereby molding a troidal core (outer diameter: 12.8 mm; inner diameter: 7.5 mm). The troidal core thus obtained was wound with 60 turns of a polyester-coated copper wire having a diameter of 0.3 mm to measure relative permeability of the resultant troidal coil at 1 V and 100 kHz. As a result, it was 16.7. The results are shown in Table 1.

Example 2

A sintered material of Mg—Zn ferrite obtained in the same manner as in Example 1 was ground by a hammer mill to obtain a powdered magnetic material having an average particle size of 38 $\mu$m. The same process as in Example 1 except that this powdered magnetic material was used was conducted. The results are shown in Table 1.

Comparative Example 1

A sintered material of Mg—Zn ferrite obtained in the same manner as in Example 1 was ground by a hammer mill to obtain a powdered magnetic material having an average particle size of 20 $\mu$m. The same process as in Example 1 except that this powdered magnetic material was used was conducted. The results are shown in Table 1.

Comparative Example 2

Mg—Zn ferrite (having the same composition as in Example 1) granulated by a pressure granulation process was fired at a temperature up to 1,300° C. to obtain a sintered material of Mg—Zn ferrite ($\mu_{iac}$ at a measuring frequency of 100 kHz:500). The section of the sintered magnetic material thus obtained was observed through a scanning electron microscope. As a result, it was found that the average crystal grain size of the crystal grains was 26 $\mu$m. This sintered magnetic material was ground by a hammer mill to obtain a powdered magnetic material having an average particle size of 21 $\mu$m. The specific gravity of the powdered magnetic material thus obtained was 4.6. The same process as in Example 1 except that this powdered magnetic material was used was conducted. The results are shown in Table 1.

Example 3

After $Fe_2O_3$ (66.2 wt. %), NiO (6.7 wt. %), ZnO (20.2 wt. %), CuO (6.6 wt. %), MnO (0.2 wt. %) and CrO (0.1 wt. %) were mixed with one another and dried, the mixture was calcined at 1,000° C. After ferrite powder obtained by the calcination was ground and then granulated by a spray drying method, the resultant granules were fired at a temperature up to 1,200° C. to obtain a sintered material of Ni—Zn ferrite ($\mu_{iac}$ at a measuring frequency of 100 kHz : 1,000). The section of the sintered magnetic material thus obtained was observed through a scanning electron microscope. As a result, it was found that the average crystal grain size of the crystal grains was 5 $\mu$m. This sintered magnetic material was ground by a hammer mill to obtain a powdered magnetic material having an average particle size of 25 μm. The specific gravity of the powdered magnetic material thus obtained was 5.1. The same process as in Example 1 except that this powdered magnetic material was used was conducted. The results are shown in Table 1.

Example 4

The same process as in Example 1 except that 18 kg of the Ni—Zn ferrite obtained in Example 3 and 2 kg of poly (phenylene sulfide) (product of Kureha Kagaku Kogyo K.K.; melt viscosity at 310° C. and a shear rate of 1,000/sec:about 20 Pa·s) were used was conducted. The results are shown in Table 1.

Comparative Example 3

After calcined Ni—Zn ferrite having the same composition as in Example 3 was ground and then granulated by a spray drying method, the resultant granules were sintered at a temperature up to 1,250° C. to obtain a sintered material of Ni—Zn ferrite ($\mu_{iac}$ at a measuring frequency of 100 kHz:1,200). The section of the sintered magnetic material thus obtained was observed through a scanning electron microscope. As a result, it was found that the average crystal grain size of the crystal grains was 31 μm. This sintered magnetic material was ground by a hammer mill to obtain a powdered magnetic material having an average particle size of 15 μm. The specific gravity of the powdered magnetic material thus obtained was 5.1. The same process as in Example 4 except that this powdered magnetic material was used was conducted. The results are shown in Table 1.

TABLE 1

| | Composition | | | | | | Average crystal grain size | Average particle size of | Dielectric | Relative |
|---|---|---|---|---|---|---|---|---|---|---|
| | Resin | | | Ferrite | | | of ferrite | ferrite | strength | permea- |
| | Kind | Wt. % | Vol. % | Kind | Wt. % | Vol. % | (μm) | (μm) | (V) | bility |
| Ex. 1 | PPS | 15 | 37 | Mg—Zn | 85 | 63 | 12 | 44 | 5,000 | 16.7 |
| Ex. 2 | PPS | 15 | 37 | Mg—Zn | 85 | 63 | 12 | 38 | 4,000 | 16.0 |
| Comp. Ex. 1 | PPS | 15 | 37 | Mg—Zn | 85 | 63 | 12 | 20 | 500 | 14.0 |
| Comp. Ex. 2 | PPS | 15 | 37 | Mg—Zn | 85 | 63 | 26 | 21 | 250 | 14.2 |
| Ex. 3 | PPS | 15 | 40 | Ni—Zn | 85 | 60 | 5 | 25 | 3,000 | 11.3 |
| Ex. 4 | PPS | 10 | 29 | Ni—Zn | 90 | 71 | 5 | 25 | 1,500 | 15.1 |
| Comp. Ex. 3 | PPS | 10 | 29 | Ni—Zn | 90 | 71 | 31 | 15 | 250 | 14.1 |

As apparent from the results shown in Table 1, the soft magnetic composite materials (Examples 1 to 4) obtained by dispersing the powdered magnetic material, the average particle diameter ($d_2$) of which was greater than the average crystal grain size ($d_1$) of the sintered magnetic material by at least twice, preferably at least 3 times, in the polymer exhibited moderate permeability and excellent dielectric strength.

On the other hand, when the average particle size ($d_2$) of the powdered magnetic material is as small as less than twice the average crystal grain size ($d_1$) of the sintered magnetic material (Comparative Examples 1 to 3), only soft magnetic composite materials which are rapidly lowered in electric resistance and poor in dielectric strength can be provided.

INDUSTRIAL APPLICABILITY

According to the present invention, there can be provided soft magnetic composite materials which have moderate permeability and moreover exhibit high electrical insulating property and have excellent dielectric strength. The soft magnetic composite materials according to the present invention can be formed into various kinds of molded or formed products (molded or formed articles and parts) such as coils, transformers, line filters and electromagnetic wave shielding materials by injection molding, extrusion, compression molding, etc.

What is claimed is:

1. A soft magnetic composite material obtained by dispersing a sintered, powdered magnetic material (A) composed of soft ferrite in a polymer (B), wherein the sintered, powdered magnetic material (A) is of a random form, and the average particle size ($d_2$) of the sintered, powdered magnetic material (A) is greater than the average crystal grain size ($d_1$) of the sintered, powdered magnetic material by at least twice.

2. The soft magnetic composite material according to claim 1, wherein the powdered magnetic material (A) is a powdered material composed of Mg—Zn ferrite.

3. The soft magnetic composite material according to claim 1, wherein the powdered magnetic material (A) is a powdered magnetic material of a random form obtained by granulating unsintered ferrite powder into granules by a spray drying method, sintering the granules and grinding the resultant sintered magnetic material.

4. The soft magnetic composite material according to claim 1, wherein the average particle size ($d_2$) of the powdered magnetic material (A) is within a range of 2 to 10 times the average crystal grain size ($d_1$) of the sintered magnetic material.

5. The soft magnetic composite material according to claim 4, wherein the average particle size ($d_2$) of the powdered magnetic material (A) is within a range of 3 to 7 times the average crystal grain size ($d_1$) of the sintered magnetic material.

6. The soft magnetic composite material according to claim 1, wherein the average crystal grain size ($d_1$) of the sintered magnetic material is within a range of 2 to 50 μm, the average particle size ($d_2$) of the powdered magnetic material (A) is within a range of 20 to 500 μm, the average particle size ($d_2$) is within a range of 2 to 10 times the average crystal grain size ($d_1$).

7. The soft magnetic composite material according to claim 6, wherein the average crystal grain size ($d_1$) of the sintered magnetic material is within a range of 3 to 15 μm, the average particle size ($d_2$) of the powdered magnetic material (A) is within a range of 20 to 50 μm, the average particle size ($d_2$) is within a range of 3 to 7 times the average crystal grain size ($d_1$).

8. The soft magnetic composite material according to claim 1, which comprises 50 to 95 vol. % of the powdered magnetic material (A) and 5 to 50 vol. % of the polymer (B).

9. The soft magnetic composite material according to claim 8, which comprises 55 to 75 vol. % of the powdered magnetic material (A) and 25 to 45 vol. % of the polymer (B).

10. The soft magnetic composite material according to claim 1, wherein the polymer (B) is at least one polymer selected from the group consisting of polyolefins, polyamides and poly(arylene sulfides).

11. The soft magnetic composite material according to claim 10, wherein the polymer (B) is a poly(arylene sulfide).

12. The soft magnetic composite material according to claim 11, wherein the poly(arylene sulfide) is poly (phenylene sulfide).

13. The soft magnetic composite material according to claim 1, wherein the dielectric strength of the soft magnetic composite material is at least 1,500 V.

14. The soft magnetic composite material according to claim 13, wherein the dielectric strength of the soft magnetic composite material is within a range of 1,500 to 8,000 V.

15. The soft magnetic composite material according to claim 14, wherein the dielectric strength of the soft magnetic composite material is within a range of 3,500 to 6,000 V.

16. The soft magnetic composite material according to claim 1, wherein the relative permeability of the soft magnetic composite material is at least 10.

17. The soft magnetic composite material according to claim 16, wherein the relative permeability of the soft magnetic composite material is within a range of 10 to 20.

18. The soft magnetic composite material according to claim 1, which is obtained by dispersing the powdered magnetic material (A) composed of soft ferrite in the polymer (B), wherein:

(1) the powdered magnetic material (A) is a powdered magnetic material of a random form obtained by grinding a sintered magnetic material, (2) the average crystal grain size ($d_1$) of the sintered magnetic material is within a range of 3 to 13 μm, (3) the average particle size ($d_2$) of the powdered magnetic material (A) is within a range of 20 to 50 μm, (4) the average particle size ($d_2$) of the powdered magnetic material (A) is within a range of 3 to 7 times the average crystal grain size ($d_1$), (5) the soft magnetic composite material comprises 55 to75 vol. % of the powdered magnetic material (A) and 25 to 45 vol. % of the polymer (B), (6) the dielectric strength of the soft magnetic composite material is within, a range of 1,500 to 8,000 V, and (7) the relative permeability of the soft magnetic composite material is within a range of 10 to 20.

19. The soft magnetic composite material according to claim 18, wherein the powdered magnetic material (A) is powder of Mg—Zn ferrite, and the dielectric strength of the soft magnetic composite material is within a range of 3,500 to 6,000 V.

20. The soft magnetic composite material according to claim 18, wherein the polymer (B) is poly(phenylene sulfide).

21. A soft magnetic composite material obtained by dispersing a sintered, powdered magnetic material (A) of a random form and composed of soft ferrite in a polymer (B), wherein:

(1) the sintered, powdered magnetic material (A) is composed of Mg—Zn ferrite, (2) the average particle size ($d_2$) of the sintered, powdered magnetic material (A) is greater than the average crystal grain size ($d_1$) of the sintered, powdered magnetic material by at least twice, (3) the soft magnetic composite material comprises 50 to 95 vol. % of the sintered, powdered magnetic material (A) and 5 to 50 vol. % of the polymer (B), and (4) the dielectric strength of the soft magnetic composite material is at least 1,500 V.

* * * * *